United States Patent [19]

Kasuga

[11] Patent Number: 4,714,040

[45] Date of Patent: Dec. 22, 1987

[54] SEWING MACHINE FOUR MOTION SPEED

[75] Inventor: Noboru Kasuga, Tokyo, Japan

[73] Assignee: Janome Sewing Machine Co., Ltd., Japan

[21] Appl. No.: 886,542

[22] Filed: Jul. 15, 1986

[30] Foreign Application Priority Data

Jul. 15, 1985 [JP] Japan ..... 60-106976[U]

[51] Int. Cl.[4] ..... D05B 27/02

[52] U.S. Cl. ..... 112/323

[58] Field of Search ..... 112/323, 303

[56] References Cited

U.S. PATENT DOCUMENTS 3,527,183 9/1970 Szostak ..... 112/323

4,199,995 4/1980 Murakami ..... 112/323 X 4,419,951 12/1983 Ruch et al. ..... 112/323

4,469,039 9/1984 Marchesi ..... 112/323

*Primary Examiner*—Andrew M. Falik

*Attorney, Agent, or Firm*—Michael J. Striker

[57] ABSTRACT

A main feed bed of a feeding mechanism of a sewing machine of a swinging lever type is provided with a sub-feed bed which is swingable with respect to said main feed bed and is integrally secured with a feed dog. Both feed beds are connected and controlled by respectively independent vertical feed cams, so that a moving locus of the feed dog is made square while keeping the upper surface of the feed dog parallel with the upper surface of a needle plate.

2 Claims, 9 Drawing Figures

SEWING MACHINE FOUR MOTION SPEED

BACKGROUND OF THE INVENTION

The present invention relates to a feed mechanism of a sewing machine.

The feed mechanism of a sewing machine of a swingable lever type has been simplified in structure, but has not been satisfactory for a fabric feed function of a feed dog.

For example, in a device shown in FIG. 6, a horizontal feed shaft 1 is pivoted, via a pin 4, at a feed bed 3 which has a feed dog 2, and the feed dog 2 is moved vertically via a feed adjusting plate 7 by means of a vertical feed cam 6 mounted on a lower shaft 5 and retable thereby. In this kind of device, if an upper surface 2*a* of feed dog 2 is set to be parallel to an upper surface 8 of the needle plate at a phase where the upper surface 2*a* of the feed dog 2 appears above the upper surface 8 of the needle plate, the upper surface 2*a* is made oblique with respect to the surface 8 of the needle plate during a fabric feed operation, because a pin 4 is positioned under the upper surface 2*a* of the feed dog 2.

As a result of the pin's position the fabric feeding efficiency is reduced and sewing mistakes such as seam shrinkage are created. is obtained by keeping the upper surface of the feed dog parallel to the upper surface of the needle plate so as to draw a square locus.

There have been proposed various attempts for providing the above mentioned square locus in the feed mechanism of the sewing machine of the swingable lever type. However, those attempts have been complicated or involved with structual difficulties.

SUMMARY OF THE INVENTION

It is an object of the invention to provide an improved feed mechanism of the sewing machine of the swinging lever type in which a main feed base is provided with a sub-feed base which is swingable with respect to said main feed base and is integrally secured with a feed dog, and the main and sub-feed bases are individually connected and controlled by independent vertical cams, so that the moving locus of the feed dog is made square while the upper surface of the feed dog is maintained parallel with the upper surface of the needle plate.

DETAILED DESCRIPTION OF PREFERRED EMBODIMENT OF THE INVENTION

Figure 1:
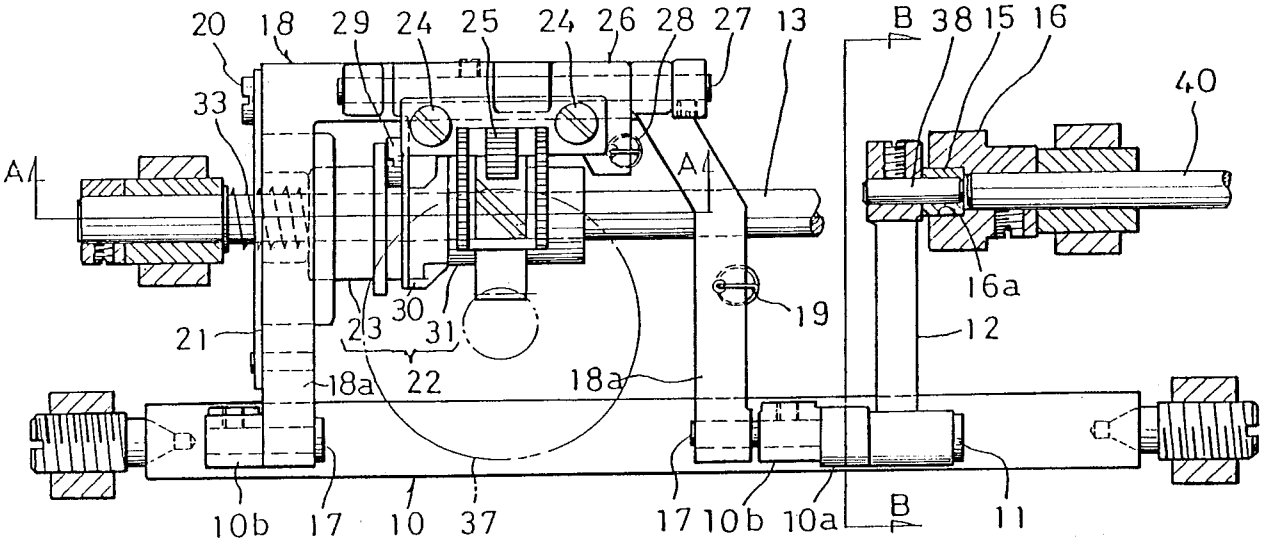
FIG. 1 is a plan view of the feeding mechanism of the invention.
Figure 3:
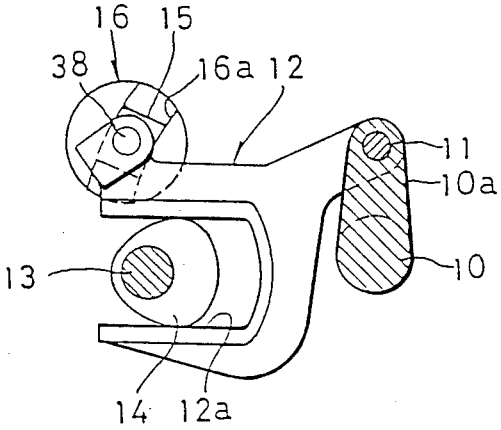
FIG. 3 is a cross sectional view taken on line III—III of FIG. 1.
Figure 7:
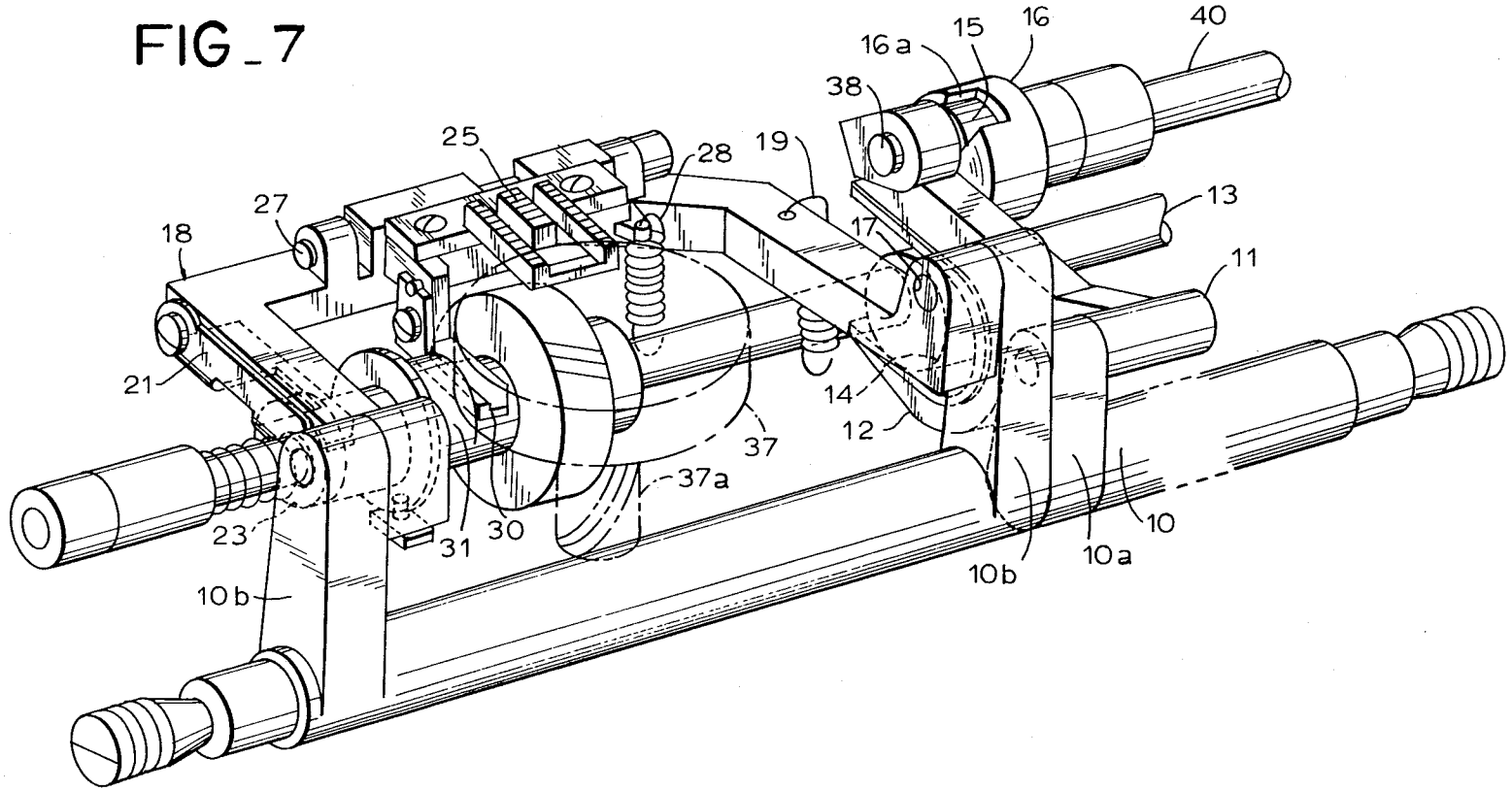
FIG. 7 is a perspective view of the main feed and subfeed bases.
Figure 8:
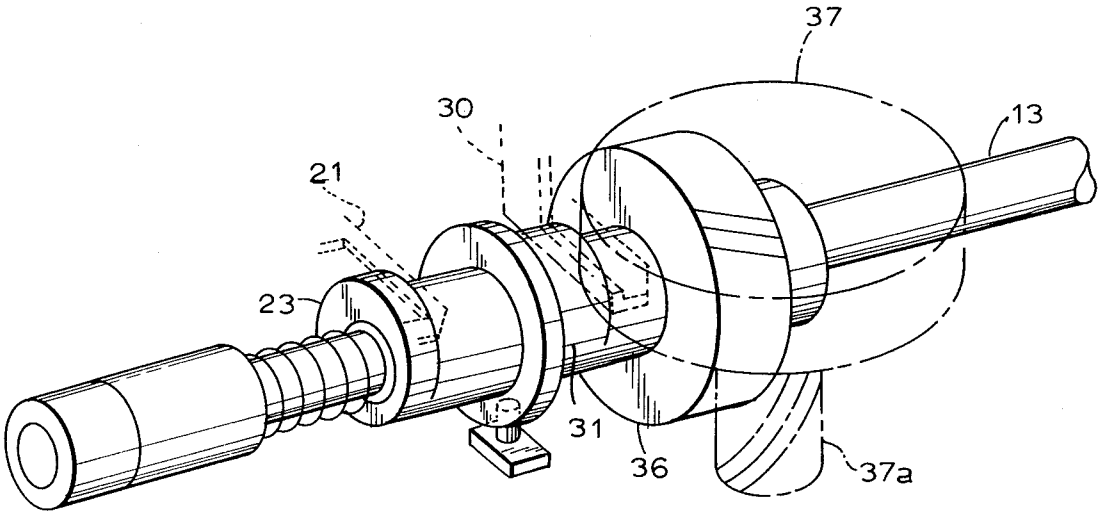
FIG. 8 is a perspective view of the drive connection for the shaft 13 shown in FIG. 3.
Figure 9:
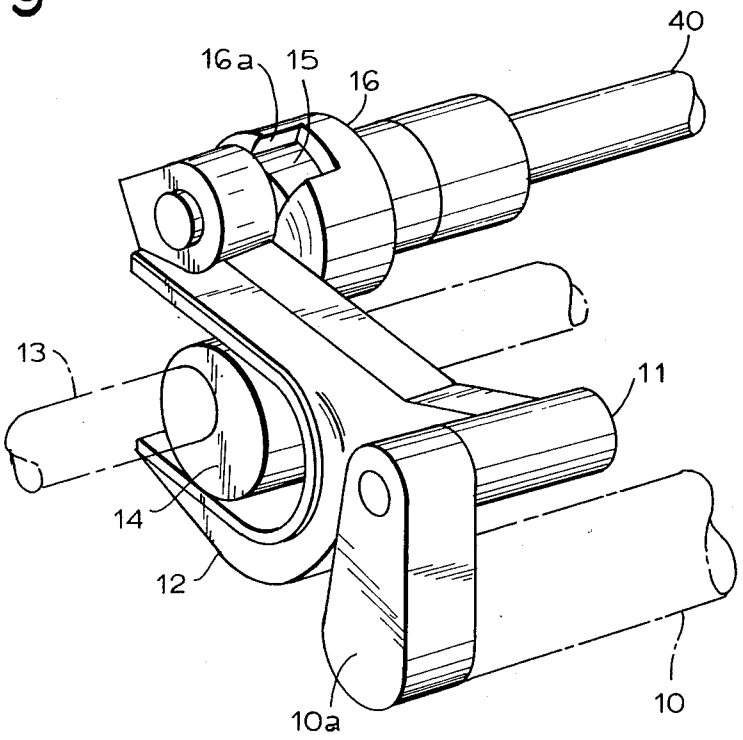
FIG. 9 is a perspective view of the fork-and-arm arrangement.

Referring now to the drawings in detail it will be seen that in FIGS. 1 and 3, numeral 10 denotes a horizontal feed shaft. A fork 12 is pivoted at a pin 11 positioned at an end part of an arm 10*a*. A fork portion 12*a* of the fork 12 is engaged with a triangular cam 14 secured on a rotatable lower shaft 13. The fork 12 is pivoted, via a pin 38, with a block member 15 which is fitted in a groove 16*a* of a feed adjusting device 16. The device 16 may be angularly adjusted due to obliquity of the groove 16*a* by a shaft 40. The block member 15 is moved within a limited range in the groove 16*a* by the fork 12 as cam 14 is rotated, and the arm 10*a* of the horizontal fed shaft 10 is swung laterally via the pin 11 and the fork 12 as clearly seen from FIG. 7. both said fork and arm comprise linkage means which causes the shaft 10 to rock or oscillate about a horizontal axis.

Figure 4:
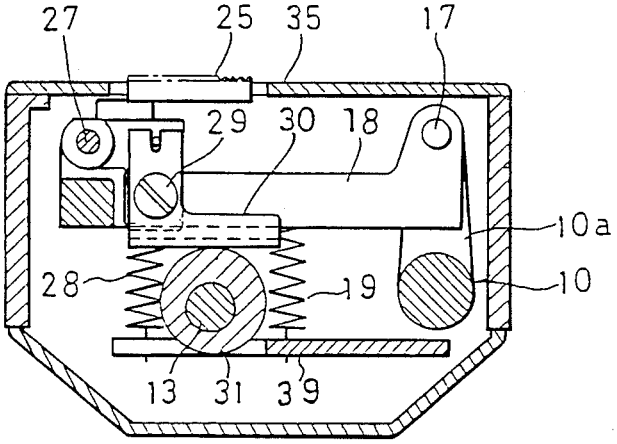
FIG. 4 is a cross sectional view taken on line IV—IV of FIG. 2.

A pair of arms 10*b* of the horizontal feed shaft 10 pivotally support a hair of arms 18*a* of a main feed base 18. The main base 18 is, as shown in FIG. 4, pulled down by a spring 19 provided between base 18 and a base plate 39. A feed adjusting follower plate 21 is attached to the main feed base 18 adjustably in vertical direction by a screw 20. The follower plate 21 engages a vertical feed cam 23 of a vertical feed cam body 22.

On the main feed base 18, a sub-feed base 26 is provided which has secured thereto a feed dog 25 by a screw 24. The feed dog is pivoted on a shaft or pins 27. The sub-feed base 26 is pulled down by a spring 28 provided between the sub-feed base 26 and the base plate 39 and follows the vertical feed body 31 of the cam 22 via the feed adjusting follower plate 30 which is adjustable in the vertical directions. Therefore it is apparent that the amount of the rocking motion of the horizontal feed shaft 10 determines the moving amount of the main feed base 18 in a horizontal plane.

Figure 2:
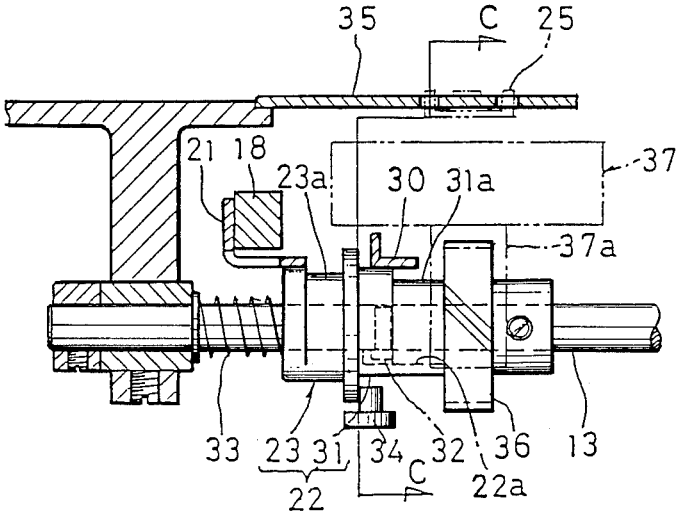
FIG. 2 is an elevational cross sectional view taken along line II—II of FIG. 1.

The vertical feed body cam 22 had an axially extending groove 22*a*, in which a key 32 is engaged, which is provided on a lower shaft 13 so that it the cam body 22 is slidable in an axial direction with respect to the lower shaft 13. Further, cam body 22 is biased by a spring 33 toward the right side in FIG. 2. If the cam 22 is moved to the left side by a drop lever 34 the main adjusting follower plate 21 engages a small lift part 23*a* of a lesser diameter than that of the cam 23 and concurrently the feed adjusting follower plate 30 engages a small lift part 31*a* of of a lesser diameter than that of the vertical feed cam 31, whereby the feed dog 25 is moved down under a needle plate 35.

The lower shaft 13 is provided with a gear 36 connected thereto for joint rotation, and the latter is in mesh with a worm 37*a* of a loop taker 37.

The main feed base 18 is vertically oscillated by the feed cam 23, whereas the sub-feed bed 26 is vertically oscillated by the vertical feed cam 31. A relationship between the vertical feed cams 22 and 31 is determined in such a manner that the amount of vertical movement of the pin 27 about which the sub-feed bed 26 is rotated is equal to and in phase with the amount of vertical movement of the sub-feed bed 26.

Figure 5:
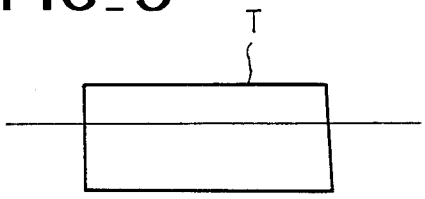
FIG. 5 shows a moving locus of a feed dog.
Figure 6:
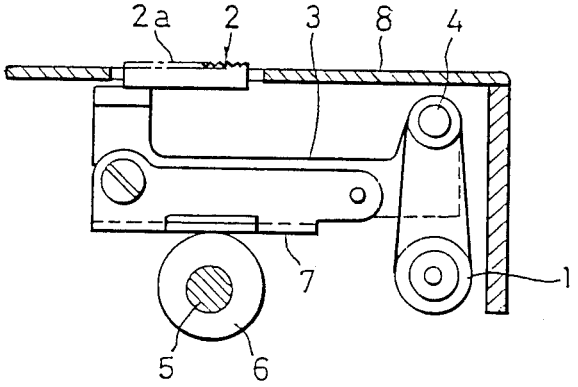
FIG. 6 shows a feed mechanism of a conventional swinging lever system.

In FIG. 5, "T" is a typical moving locus of the feed dog which is schematically shown with addition of the lateral feed. The actual moving locus however could be varied by the geometries of the vertical feed cams.

The moving locus in the vertical direction is determined by a position of pin 27 about which the feed dog 25 is povotable, with respect to the horizontal plane passing through the axis of the pin 17 about which the base 18 is pivotable. A desired moving locus in the vertical direction may be provided by adjusting the cam and follower means 23 and 21 to move the pin 27 to different levels from the pin 17 when the feed dog 25 appears above the needle plate face 35.

The actuation of the feed mechanism of the invention will be explained below.

The vertical movement due to the vertical feed cam 23 of the pin 27 about which the sub-feed base 26 is rotated, agrees to the amount of the vertical movement of the sub-feed base 26 by the vertical feed cam 31, and they are both also in phase. Thus, the feed dog 25 is moved vertically while the feed dog is maintained parallel to the needle plate surface 35. With the additional horizontal movement of the base feed 18, the feed dog 25 is moved in a desired path to feed the fabric efficiently.

Accordingly, the main feed bed of the feeding mechanism of the sewing machine of the swinging lever type is provided with the sub-feed bed which is swingable with respect to said main feed bed and is integrally secured with the feed dog, and these feed beds are connected and controlled by the respectively independent vertical feed cams, so that the moving locus of the feed dog is made square while the upper surface of the feed dog is maintained parallel with the upper surface of the needle plate.

What is claimed is:

1. A feeding mechanism of a sewing machine including a feed dog vertically and horizontally movable to feed a fabric to be sewn with respect to a needle plate, a feed shaft (10) rockable about a horizontal axis to move the feed dog in a horizontal plane, cam and link means for rocking said feed shaft about said horizontal axis, and a further shaft (13) rotated to drive a loop taker (37) and said cam and link means, the feeding mechanism comprising a first feed base (18) having one end pivotably connected to said feed shaft; a second feed base (26) to which said feed dog is secured, said second feed base being pivotably supported on said first feed base at another end thereof; a first cam (23) secured to said further shaft (13) for rotation therewith, said first cam engaging said first feed base to vertically shift the same while said first feed base is moved in a horizontal plane by said feed shaft, and a second cam (31) secured to said further shaft (13) for rotation therewith, said second cam engaging said second feed base to vertically shift the same while said first feed base is moved in said horizontal plane.

2. The feeding mechanism as defined in claim 1, further comprising a follower plate (30) adjustably secured to said second feed base and engaging said second cam.

* * * * *